US006205620B1

(12) United States Patent
Hogan

(10) Patent No.: US 6,205,620 B1
(45) Date of Patent: Mar. 27, 2001

(54) FIBRE PROCESSING APPARATUS

(75) Inventor: Brian David Hogan, Rait (GB)

(73) Assignee: WM R Stewart & Sons, LTD (GB)

( * ) Notice: Subject to any disclaimer, the term of this patent is extended or adjusted under 35 U.S.C. 154(b) by 0 days.

(21) Appl. No.: 09/253,289

(22) Filed: Feb. 19, 1999

(51) Int. Cl.[7] ..... D01G 15/12
(52) U.S. Cl. ..... 19/113; 19/104; 19/110
(58) Field of Search ..... 19/98, 99, 102, 19/104, 110, 111, 113, 114

(56) References Cited

U.S. PATENT DOCUMENTS

| | | | | |
|---|---|---|---|---|
| 54,450 | * | 5/1866 | Waite | 19/114 |
| 1,653,596 | * | 12/1927 | Arnold | 19/114 |
| 3,290,729 | * | 12/1966 | Maynard | 19/114 |
| 3,737,953 | * | 6/1973 | Bechtel, Jr. | 19/113 |
| 4,074,392 | * | 2/1978 | Bechtel, Jr. | 19/113 |
| 4,510,949 | * | 4/1985 | Preston et al. | 19/114 |

FOREIGN PATENT DOCUMENTS

| | | | | |
|---|---|---|---|---|
| 0 481 175 A1 | | 7/1991 | (DE) | D01G/19/10 |
| 1696 | * | 1/1857 | (GB) | 19/114 |
| 1319 598 | | 6/1973 | (GB) | D01G/15/90 |
| 1 474 889 | | 5/1977 | (GB) | D01G/15/86 |
| 1543334 | * | 4/1979 | (GB) | 19/113 |
| 2032477 | * | 5/1980 | (GB) | 19/113 |
| 2 042 603 | | 9/1980 | (GB) | D01G/19/10 |
| 1 298 561 | | 3/1991 | (GB) | B23P/17/00 |

* cited by examiner

*Primary Examiner*—John J. Calvert
*Assistant Examiner*—Gary L. Welch
(74) *Attorney, Agent, or Firm*—Frank J. Dykas; Robert L. Shaver

(57) ABSTRACT

A method of producing apparatus for use in fiber processing, and in particular blades for pre-carding flats in a cotton card. The method comprises the steps of providing a body (32) defining a multiplicity of bores (34) extending between rear and front faces thereof, providing a multiplicity of pointed pins (44) of corresponding diameter to the bores, locating the pins (44) in the bores (34) from the rear of the body such that the points extend from the front of the body, and fixing the pins in the body.

41 Claims, 2 Drawing Sheets

FIBRE PROCESSING APPARATUS

FIELD OF THE INVENTION

The present invention relates to fibre processing apparatus, and in particular, but not exclusively, to apparatus forming part of a cotton card.

BACKGROUND OF THE INVENTION

During the processing of raw cotton, following initial cleaning and processing and prior to spinning, the cotton fibres are separated from one another on a machine known as a card. The cleaned raw cotton is lifted from a conveyor by a take-in cylinder and transferred onto a main card cylinder, the surface of which carries a large number of wire points, typically at a density of around 1000 points per square inch. The rotating main cylinder carries the cotton beneath a set of stationary pre-carding flats, typically formed of three blades, each blade extending across the cylinder surface parallel to the cylinder axis. Each blade carries a large number of "wires", that is metal strips blanked out to form a number of teeth. The strips are mounted together on a thin bar and clipped to a support.

Beyond the pre-carding flats, the main cylinder passes the cotton beneath a set of revolving flats which may be mounted on a caterpillar-like track. The cylinder then carries the cotton beneath a further set of stationary flats, before a doffer roller transfers the cotton from the main cylinder to a further conveyor which carries the carded cotton on for further processing.

Wire flats provided on continuously operating cards generally have to be replaced every three months. The replacement operation may only be carried out when the card is shut down, resulting in a loss of production. Further, the quality of cotton produced by a card drops as the teeth of the flats are subject to wear.

It is among the objectives of embodiments of the present invention to provide flat blades which have a longer life than conventional wire flats and to provide an efficient method of producing such flats.

SUMMARY OF THE INVENTION

According to the present invention there is provided a method of producing apparatus for use in fibre processing, the method comprising the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body.

The invention also relates to apparatus produced by this method.

The invention facilitates the manufacture of pinned products, such as blades of flats for cotton cards. The resulting products also tend to have a longer working life than corresponding wire blades.

In conventional pinned products, such as take-in rollers for cotton cards, the pins are located "tail-first" in bores drilled in a metal tube. This is normally achieved by filling a cartridge with a row of pins, and then locating the pins held in the cartridge, tail first, in a row of bores. Adhesive is then brushed around the pins and travels, by capillary action, into the bores. This assembly process is labour-intensive and becomes more difficult as the point density increases. Further, pins of this size tend to be formed from longer lengths of metal which have one end formed into points, the pointed ends then being cut off to form the relatively short pins. The cutting operation tends to produce a pin with a flattened tail. To avoid problems locating the deformed tails in the bores, the pins are deburred by polishing. However, the polishing operation also tends to dull the point. The present invention reduces or obviates the need for deburring, as the burrs or bore walls may simply deform as the pin, already located in the bore, is pressed further into the bore. Alternatively, and preferably, the body thickness between the faces and the pin length may be selected such that the pin tails do not enter the respective bores.

Preferably, the body is adapted to be mounted on a support. Conveniently, the body and support are in the form of elongate members adapted to inter-engage, and most preferably channels with side walls adapted to inter-engage. Most preferably, the channels are arranged to snap-fit together. The support may be adapted to engage with a blade mounting arrangement of a card.

Preferably also, the bores are provided at an acute angle to the front body face, such that the pins are angled when located in the body.

Preferably also, the pins are fixed in the bores by settable material, most preferably a polymer, such as a UV-curable anaerobic polymer various forms of which are sold under the LOCTITE trade mark.

The pin points may lie in a common flat plane, or may lie in a curved plane, the latter arrangement allowing provision of a relatively wide body to, for example, co-operate with the main cylinder of a cotton card.

The pins may have a shaft of substantially constant cross-section, or may have tails of relatively large cross-section, to prevent the pins entering the bores tail first.

According to another aspect of the present invention there is provided apparatus for use in fibre processing, the apparatus comprising:

a body defining a multiplicity of bores extending between rear and front faces thereof; and a multiplicity of pointed pins having shafts of corresponding diameter to the bores and tails of greater diameter than the bores, the pins being fixed in the bores such that the points extend from the front of the body.

According to a further aspect of the present invention, there is provided an apparatus for use in fibre processing, the apparatus comprising; a body defining a plurality of points; and a support for the body, the body and support combining to define a channel for engaging a corresponding mounting profile on a card.

Preferably, said channel is an undercut channel.

Preferably, said body includes a number of ribs, for interlocking with said support. Preferably also said ribs snap-fit together with said support. Preferably also all or some of said ribs define part of said channel.

Preferably, said support includes a plurality of sections.

More preferably, said support includes two longitudinal sections.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
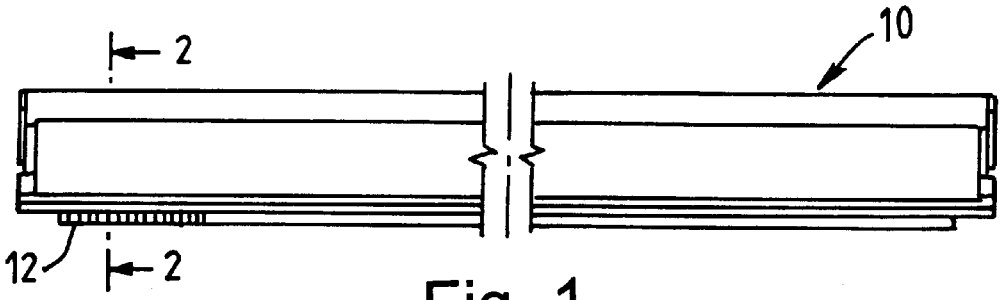
Fig. 1 (PRIOR ART)
FIG. 1 is a side view of a prior art blade of a pre-carding flat of a cotton card.
Figure 2:
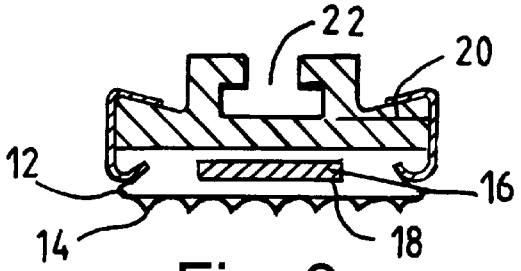
Fig. 2 (PRIOR ART)
FIG. 2 is a sectional view on line 2—2 of FIG. 1.

Reference is first made to FIGS. 1 and 2 of the drawings, which illustrate a typical prior art blade 10 for a pre-carding flat of a cotton card. The blade 10 comprises a large number of "wires" 12, that is small sections of metal which have been blanked to form pointed teeth 14. The wires 12 each define a rectangular aperture 16 to permit the wires 12 to be mounted on a bar 18. The wires 12 are then clipped onto a support 20 defining a channel 22 to permit the blade 10 to be mounted in the card.

Figure 3:
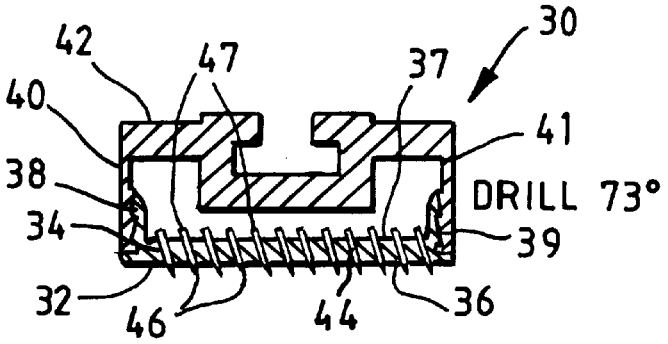
FIGS. 3, 4 and 5 are sectional views of pre-carding flat blades in accordance with embodiments of the present invention.

Reference is now made to FIG. 3 of the drawings, which illustrates a sectional view of a blade 30 in accordance with an embodiment of the present invention. The blade 30 comprises a generally rectangular channel-shaped body 32 in which a large number of through bores 34 have been drilled at an acute angle (73°) to the front and rear faces 36, 37 of the body. The body 32 has side portions 38, 39 profiled to snap-fit with corresponding profiles defined by side portions 40, 41 of a further channel-shaped support member 42 on which the body 32 is mounted. The body 32 and member 42 are aluminium alloy extrusions, the member 42 being slightly more flexible than the body 32. Each body bore 34 accommodates a high carbon steel pin 44, the pin points 46 extending from the body front face 36 and the pin tails 47 extending from the rear face 37. The pin points 46 may lie on a common flat plane, or may lie on a curved plane, corresponding to the circumference of the main cylinder of the card.

The pins 44 are located in the bores 34 point first, that is the pins 44 are dropped into the bores 34 from the rear of the body 32. This operation may be carried out using appropriate apparatus and at relatively high speed, utilising vibration to locate the pins 44 in the bores 34. The body front face is spaced a predetermined distance from a gauge surface during this operation, such that the pin points 46 lie in the desired plane, in contact with the gauge surface. Adhesive is then brushed or sprayed over the rear face 37 and is drawn into the spaces between the pins 44 and the bore walls by capillary action. Once cured, the adhesive retains the pins 44 securely in the body 32. The member 42 may then be clipped in place onto the body 32, and the blade 30 is ready to be fitted to a carding machine.

As described above, the pins 44 are produced by cutting the ends from longer pointed pins, which tends to deform the pin tails 47. However, such deformation does not affect placement of the pins in the body 32, as the tails 47 remain clear of the bores 34.

Figure 4:
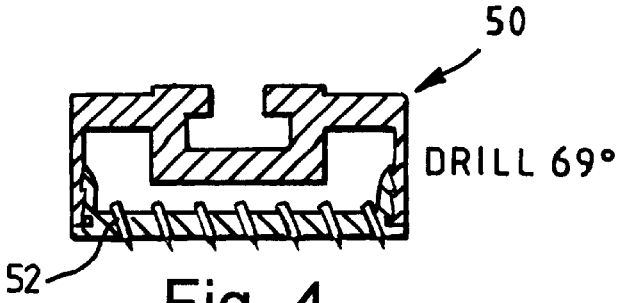

Reference is now made to FIG. 4 of the drawings, which illustrates a blade 50 in accordance with another embodiment of the present invention. The blade 50 is similar to the blade 30 described above, but is provided with thicker pins 52 at a lower point density and the pins 52 are angled differently (at 69° as opposed to 73°).

Figure 5:
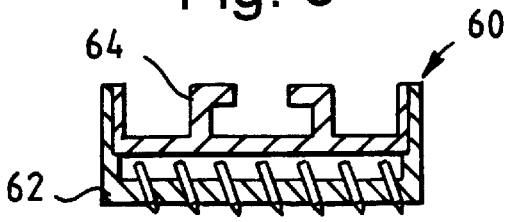

Reference is now made to FIG. 5 of the drawings, which illustrates a blade 60 in accordance with another embodiment of the present invention.

The blade 60 comprises a channel-shaped pin-supporting body 62 and a channel-shaped support member 64. However, the blade 60 differs from the blades 30, 50 described above in that the member 64 nests within the body 62.

Figure 6:
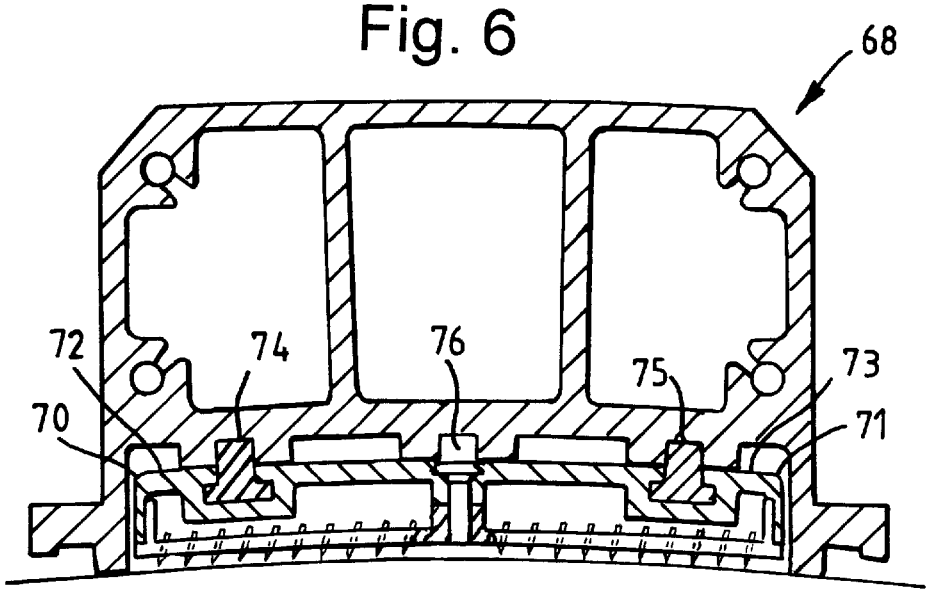
FIG. 6 is a sectional view of a pre-carding flat in accordance with another embodiment of the present invention.

Reference is now made to FIG. 6 of the drawings, which illustrates a flat 68, including blades 70, 71 in accordance with another embodiment of the present invention. The flat 68 would normally provide mounting for three blades, however in this embodiment, two wider blades 70, 71 are provided, the blade support members 72, 73 being profiled to engage with mounting profiles 74, 75 and screws 76 on the flat. In other embodiments, a wider single blade could be provided for mounting in the flat 68. In such embodiments, it is preferable that the blades comprise a curved body and the pin points lie in a curved plane corresponding to the circumference of the main cylinder of the cotton card.

Figure 7:
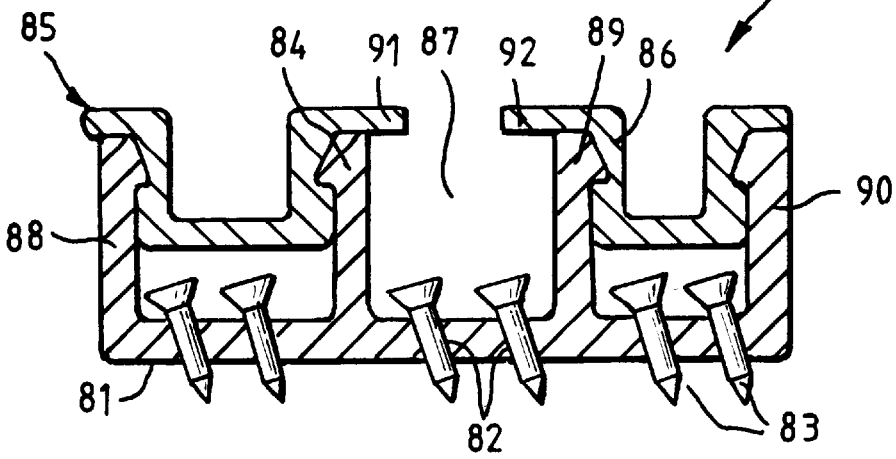
FIG. 7 is a cross-section of a carding flat in accordance with a further embodiment of the present invention.

Reference is now made to FIG. 7 of the accompanying drawings, which illustrates a cross-section of a blade 80 in accordance with a further embodiment of the present invention. The blade 80 comprises a body 81 with a number of bores 82 through which are mounted many pins 83, as described above: it will be seen that the pins 83 have tails of greater diameter than the bores 82 in order to prevent the pins entering the bores tail first. The body 81 defines four longitudinally extending ribs 84, 88, 89, 90 profiled to interlock with two separate supports 85, 86. These supports 85, 86 together define a central undercut channel 87 for co-operation with an inverted T-shaped flat-mounting profile on a card (see FIG. 6).

In cross-section, the supports 85, 86 define two substantially "U" -shaped pieces, the lower portions of the legs of each "U" being profiled so as to interlock with corresponding profiling on the ribs of the body. The supports further possess flanges 91, 92 extending inwardly to partially enclose the area between the ribs 84, 89. The profile defined by the flanges 91, 92 in co-operation with the ribs 84, 89 and the body 81 is of a suitable shape for mounting the entire flat assembly on an inverted T-shaped flat-mounting profile on a card.

The ribs 84, 88, 89, 90 are further placed so as to provide sufficient access to the rear of the body, when the supports are not present, for insertion and mounting of the pins 83 through the bores 82 during manufacture of the flats.

It will also be noted that the embodiment described in FIG. 7 has a significantly lower profile and uses less construction material than the other illustrated embodiments.

In use, the blades 30, 50, 60, 70, 71 and 80 described have a significantly longer life than conventional wire blades 10, and also produce cotton of consistent quality throughout the blade life, the pins being self-sharpening.

It will be clear to those of skill in the art that the above-described embodiments are merely exemplary of the present invention and that various modifications and improvements may be made thereto without departing from the scope of the invention. The above embodiments are blades of stationary flats for a cotton card, but the invention may be utilised in other elements of a card, and indeed in other forms of natural and synthetic fibre processing apparatus.

What is claimed is:

1. A method of producing apparatus for use in fiber processing, the method comprising in the following order the steps:

providing a body defining a multiplicity of bores extending between rear and front faces thereof;

providing a multiplicity of pointed pins of corresponding diameter and of similar cross section to the bores;

locating the pins in the bores from the rear of the body such that the points extend from the front of the body; and adhesively fixing the pins in the body.

2. The method of claim 1, wherein the body thickness between the faces and the pin length is selected such that the pin tails do not enter the respective bores.

3. The method of claim 2, further comprising providing pins having tails of greater diameter than the bores.

4. The method of claim 1, further comprising adapting the body to be mounted on a support by providing the body and the support in the form of channels with side walls which inter-engage.

5. The method of claim 4, further comprising snap-fitting the channels together.

6. The method of claim 4, further comprising engaging the support with a blade mounting arrangement of a card.

7. The method of claim 1, further comprising forming the bores at an acute angle to the front body face, such that the pins are angled when located in the body.

8. The method of claim 1, wherein the body is vibrated to locate the pins in the bores.

9. An apparatus for producing fibers, said apparatus comprising:

a body defining a multiplicity of bores extending between rear and front faces thereof;

a multiplicity of pointed pins of corresponding diameter and of similar cross section to the bores;

said pins located in the bores from the rear of the body such that the points extend from the front of the body; and said pins being adhesively fixed in the body.

10. The apparatus of claim 9, wherein the body thickness between the faces and the pin length is such that the pin tails do not enter the respective bores.

11. The apparatus of claim 10, wherein the pins have tails of greater diameter than the bores.

12. The apparatus of claim 9, wherein the body is mounted on a support.

13. The apparatus of claim 12, wherein the body and support are elongate members in the form of channels with side walls which inter-engage.

14. The apparatus of claim 13, wherein the channels snap-fit together.

15. The apparatus of claim 12, wherein the support engages with a blade mounting arrangement of a card.

16. The apparatus of claim 9, wherein the body bores are provided at an acute angle to the front body face, such that the pins are angled when located in the body.

17. The apparatus of claim 9, wherein the pin points lie in a common flat plane.

18. The apparatus of claim 9, wherein the pin points lie in a curved plane.

19. The apparatus of claim 9, wherein the apparatus is a blade of a flat for a cotton card.

20. Apparatus for use in fiber processing, the apparatus comprising:

a body defining a multiplicity of bores extending between rear and front faces thereof; and a multiplicity of pointed pins having shafts of corresponding diameter and of similar cross section to the bores and tails of greater diameter than the bores, the pins being adhesively fixed in the bores such that the points extend from the front of the body.

21. An apparatus for use in fiber processing and for mounting on a card, the apparatus comprising a body defining a plurality of points; and a separate support for said body, said body and said support combining to define a channel for engaging a corresponding mounting profile on the card.

22. The apparatus of claim 21, wherein said channel is an undercut channel.

23. The apparatus of claim 21, wherein said body includes a number of ribs, for interlocking with said support.

24. The apparatus of claim 23, wherein said ribs snap-fit together with said support.

25. The apparatus of claim 23 wherein said ribs define part of said channel.

26. The apparatus of claim 21, wherein said support includes a plurality of sections.

27. The apparatus of claim 26, wherein said support includes two longitudinal sections.

28. A method of producing apparatus for use in fiber processing, the method comprising the steps:

providing a body defining a multiplicity of bores extending between rear and front faces thereof, providing a multiplicity of pointed pins of corresponding diameter to the bores;

locating the pins in the bores from the rear of the body such that the points extend from the front of the body; and fixing the pins in the body;

wherein the body is vibrated to locate the pins in the bores.

29. An apparatus for use in fiber processing and for mounting on a card, the apparatus comprising a body defining a plurality of points; and a support for said body and said body and said support combining to define a channel of engaging a corresponding mounting profile on the card, wherein said body includes a number of ribs, for interlocking with said support.

30. The apparatus of claim 29, wherein said ribs snap-fit together with said support.

31. A method of producing apparatus for use in fiber processing, the method comprising in the following order the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body;

further comprising adapting the body to be mounted on a support by providing the body and the support in the form of channels with side walls which inter-engage.

32. The method of claim 31, further comprising snap-fitting the channels together.

33. The method of claim 31, further comprising engaging the support with a blade mounting arrangement of a card.

34. A Method of producing apparatus for use in fiber processing, the method comprising the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body;

wherein the body is vibrated to locate the pins in the bores.

35. Apparatus made in accordance with a method comprising in the following order the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body;

wherein the body is mounted on a support and wherein the body and support are elongate members in the form of channels with side walls which inter-engage.

36. The apparatus of claim 35, wherein the channels snap-fit together.

37. Apparatus made in accordance with a method comprising in the following order the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body;

wherein the body is mounted on a support and wherein the support engages with a blade mounting arrangement of a card.

38. Apparatus made in accordance with a method comprising in the following order the steps:

providing a body defining a multiplicity of bores extending between rear and front faces thereof;

providing a multiplicity of pointed pins of corresponding diameter to the bores;

locating the pins in the bores from the rear of the body such that the points extend from the front of the body; and fixing the pins in the body;

wherein the apparatus is a blade of a flat for a cotton card.

39. An apparatus for use in fiber processing and for mounting on a card, the apparatus comprising a body defining a plurality of points; and a support for said body, said body and said support combining to define a channel for engaging a corresponding mounting profile on the card, wherein said body includes a number of ribs, for interlocking with said support.

40. The apparatus of claim 39, wherein said ribs snap-fit together with said support.

41. The apparatus of claim 39, wherein said ribs define part of said channel.

* * * * *